US007163489B1

(12) United States Patent
Nelson

(10) Patent No.: US 7,163,489 B1
(45) Date of Patent: Jan. 16, 2007

(54) DEVICE AND METHOD FOR INITIATING AN EXERCISE ROUTINE

(76) Inventor: Webb Nelson, 19180 144th Ave. NE., Woodinville, WA (US) 98072

( * ) Notice: Subject to any disclaimer, the term of this patent is extended or adjusted under 35 U.S.C. 154(b) by 460 days.

(21) Appl. No.: 10/783,903

(22) Filed: Feb. 20, 2004

Related U.S. Application Data

(63) Continuation-in-part of application No. 09/634,535, filed on Aug. 8, 2000, now abandoned.

(51) Int. Cl.
*A63B 21/00* (2006.01)
*A63B 22/00* (2006.01)

(52) U.S. Cl. ..... 482/8; 482/1; 482/9

(58) Field of Classification Search ..... 482/1–9, 482/900–902; 434/247
See application file for complete search history.

(56) References Cited

U.S. PATENT DOCUMENTS 6,626,800 B1 * 9/2003 Casler ..... 482/8
6,808,472 B1 * 10/2004 Hickman ..... 482/8
6,876,496 B1 * 4/2005 French et al. ..... 359/630

* cited by examiner

*Primary Examiner*—Glenn Richman
(74) *Attorney, Agent, or Firm*—LaMorte & Associates

(57) ABSTRACT

A device and method for motivating a person to start and maintain an exercise routine. A handheld electronic device is provided that includes a display. The electronic device randomly selects times that exercise should be performed. At those times, a person is prompted to select a type of exercise that is appropriate for the location and circumstances that person finds him/herself. After selecting the appropriate type of exercises, the selected exercises are portrayed on the display of the device. The device also sets a time frame in which the various exercises are to be completed and motivates a person to perform the exercises within that time frame. At the end of the time period, the device prompts the user as to whether or not the various exercises were performed in the given time period. A fitness report is then displayed showing improved or declining fitness.

20 Claims, 4 Drawing Sheets

DEVICE AND METHOD FOR INITIATING AN EXERCISE ROUTINE

RELATED APPLICATIONS

This application is a continuation-in-part of U.S. patent application Ser. No. 09/634,535, filed Aug. 8, 2000 now abandoned and entitled Device And Method For Initiating An Exercise Routine.

BACKGROUND OF THE INVENTION

1. Field of the Invention

In general, the present invention relates to hand-held programmable electronic devices that can be programmed to remind a person of different events scheduled at different times. More specifically, the present invention device relates to programmable electronic devices that are used to help a person plan and initiate an exercise routine.

2. Description of the Prior Art

The prior art is replete with various electronic devices that can be programmed to perform various data management tasks. Palm-top computers are the most dynamic of such devices. Palm-top computers are miniature personal computers capable of running a wide range of software. As such, the uses for palm-top computers are only as limited as is the software available for that computer. However, palm-top computers are expensive and therefore are not typically purchased by people who have little use for the software processing capabilities of such devices.

Rather, in the field of consumer electronics, there are many electronic devices that run only a single dedicated program. Such devices include electronic calendars, electronic address books, electronic language translators and the like. Such devices are programmed with a single program and do not require a dynamic processor. Consequently, dedicated electronic devices typically are far less expensive than are the more versatile palm-top computers.

Among the many dedicated consumer electronic devices that exist are devices directed toward health and exercise. There are many electronic devices that are used to monitor food intake so that a person can keep to a diet. Many times such electronic devices are incorporated into wristwatches. Still other electronic devices exist that are used to monitor the burning of calories during various types of exercise. Although such prior art electronic devices are useful to people on a diet and people who exercise, such devices do not directly motivate a person to better their health.

A need therefore exists for a dedicated electronic device that is low cost and acts as a virtual gym or a virtual trainer, so as to motivate a person to better their health through a structured program. This need is met by the present invention as it is described and claimed below.

SUMMARY OF THE INVENTION

The present invention is a virtual trainer device and method for motivating a person to start and maintain an exercise routine. The virtual trainer device is a hand-held electronic device that includes a display. Randomly, throughout each day, the electronic device indicates that exercise should be performed. At those times, a person is prompted to select a type of exercise that is appropriate for the location and circumstances in which that person finds himself/herself at that time. After selecting the appropriate type of exercises, the selected exercises are portrayed on the display of the device. The virtual trainer device also sets a time frame in which the various exercises are to be completed and motivates a person to perform the exercises within that time frame, as would a trainer or coach. At the end of the time period, the virtual trainer device prompts the user as to whether or not the various exercises were performed in the given time period. A fitness report is then displayed showing improved or declining fitness.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention virtual trainer device and method can be used to present an exercise routine in many different specialty disciplines, such as yoga, karate and the like, the present invention is especially suitable for presenting an exercise routine using commonly known callisthenic exercises and everyday activities. Consequently, the first embodiment of the present invention virtual trainer device and method will be described using traditional well known exercises in order to set forth the best embodiment contemplated.

Figure 1:
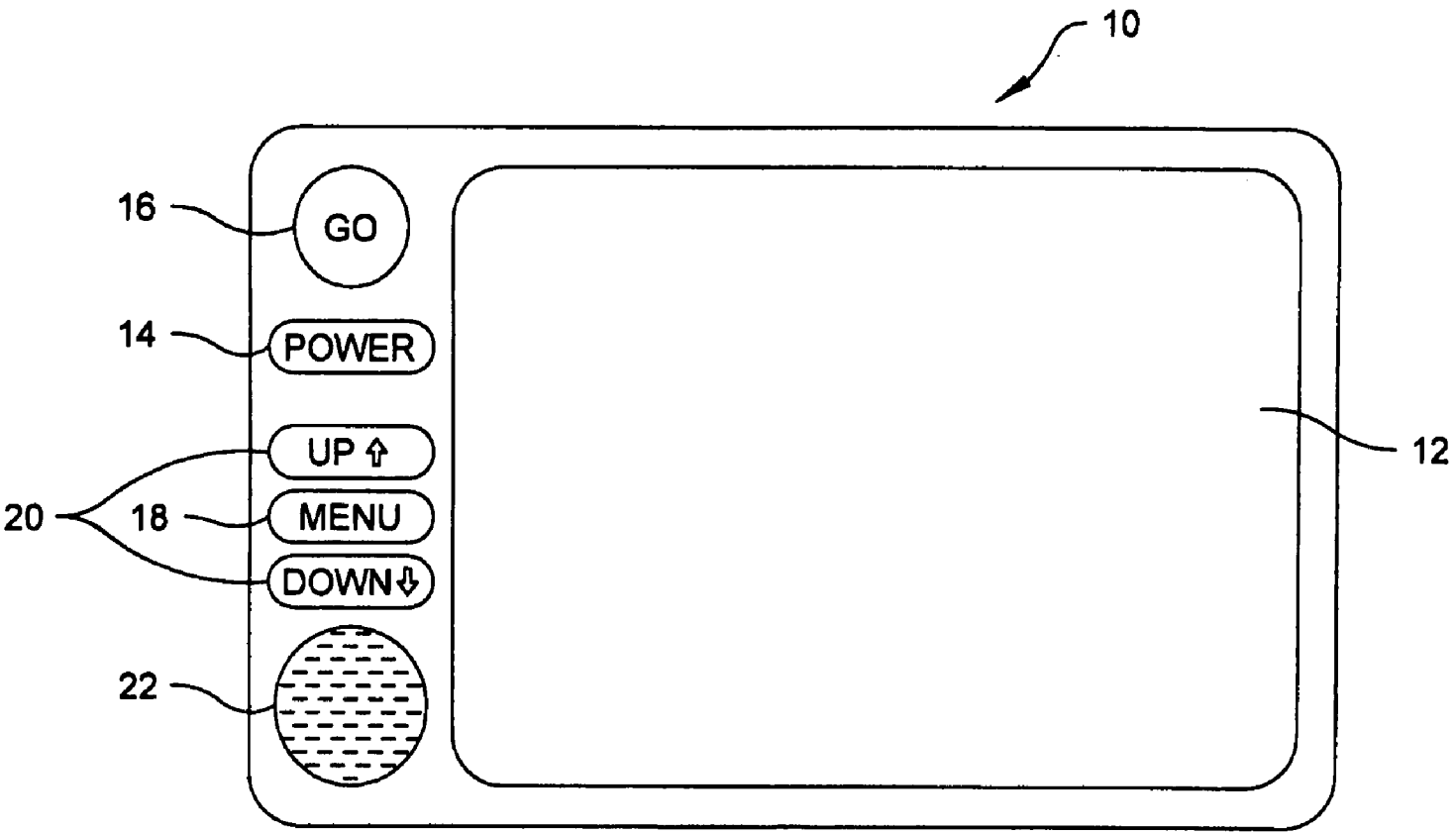
FIG. 1 is a front view of an exemplary embodiment of a virtual trainer device in accordance with the present invention.

Referring to FIG. 1, a first embodiment of an electronic virtual trainer device 10 is shown in accordance with the present invention. The virtual trainer device 10 is a hand-held device that is sized to readily fit into a person's pocket. In alternate embodiments, the virtual trainer device 10 can be formed into a wristwatch or shaped like a credit card so that it can be carried in a person's wallet.

The virtual trainer device 10 has a liquid crystal display (LCD) 12. To the side of the display 12 is a bank of function buttons. The function buttons include a "Power" button 14, a "GO" button 16, a "Menu" button 18 and directional buttons 20. The virtual trainer device 10 also contains a speaker 22. The display 12 enables the virtual trainer device 10 to present visual messages, while the speaker 22 enables the virtual trainer device 10 to present audible messages.

The purpose of the virtual trainer device 10 is to prompt a user to initiate an exercise routine. The virtual trainer device 10 provides an indication as to when to perform exercises, provides a visual indication of how to properly perform those exercises and provides a fitness update upon the completion or non-completion of the exercises.

Figure 2:
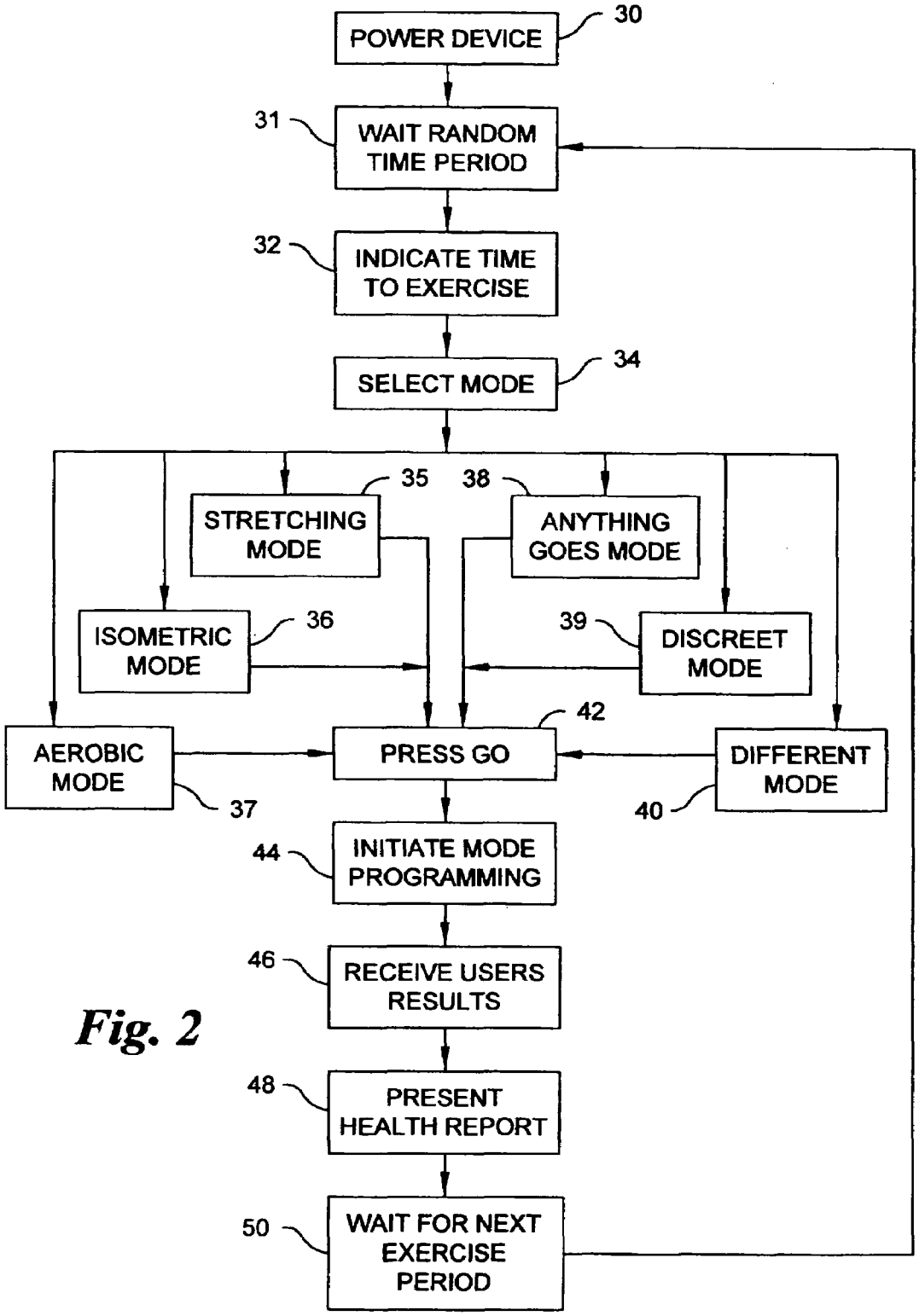
FIG. 2 is schematic flow diagram of the method of operation for the virtual trainer device.

Referring to FIG. 2, the method of operation of the present invention virtual trainer device can be explained. First the electronic device is turned on using the "POWER" button (FIG. 1). This is indicated by Block 30. Once the virtual trainer device is operational, the virtual trainer device can be programmed to indicate times to exercise periodically during the day. The programmed times can be set to be periodical, such as every thirty minutes, or can be time triggered, such as 12 o'clock. However, in the preferred embodiment, the virtual trainer device randomly selects times to exercise during the period of time that the virtual trainer device is in operation. See Block 31. A minimum time between random exercise periods is provided. This minimum period being at least fifteen minutes. In this manner, the virtual trainer device cannot randomly select consecutive exercise periods within fifteen minutes of each other. This provides the user of the virtual trainer device with a period to rest in between exercise sessions. Similarly, a maximum period between random exercise periods can also be used. This maximum period is preferably no longer than ninety minutes. In this way, the virtual trainer device will not randomly select consecutive exercise periods that are more than ninety minutes apart. This prevents any long period of inactivity to occur during the day. However, between the minimum period and the maximum period, a user of the virtual trainer device has no way of telling when a randomly selected exercise period will occur.

When an exercise period does randomly occur, the virtual trainer device produces a visual indication on the display 12 when it is time to exercise and/or produces an audible indication using the speaker 22 (FIG. 1). The step of indicating that it is time to exercise is shown in Block 32 of FIG. 2.

Since the timer to exercise is randomly selected, a person using the virtual trainer device has no way of predicting where they will be or what they will be doing when an exercise period occurs. For this reason, a user is provided with a selection of possible exercises so that the user can select the exercises best suited for their circumstances at that time. Once the virtual trainer device has indicated that it is time to exercise, a user can press the menu button 18 (FIG. 1) and select an operational mode using the directional buttons 20 (FIG. 1). The menu button 18 (FIG. 1) presents a menu on the display (FIG. 1). Using the directional buttons 20 (FIG. 1), a user can select different options from the menu being displayed.

The user of the virtual trainer device is first prompted to select an operational mode for the device. The step of selecting different operational modes is shown in Block 34 in FIG. 2. The virtual trainer device has multiple modes depending upon the situation of the user. Among the modes present in the menu are the Stretching Mode 35, the Isometrics Mode 36, the Aerobics mode 37, the Anything Goes Mode 38, the Discreet Mode 39 and the Different Mode 40. Once a specific operational mode is selected, a user presses the GO button 16 (FIG. 1) on the virtual trainer device and programming dedicated to that mode is initiated, as is indicated by Block 42 and Block 44, respectively. During the running of the program for each mode, different exercises are displayed and demonstrated on the display 12 (FIG. 1) of the virtual trainer device. Each mode presents a window of time in which to perform the displayed exercises. After every exercise period, the user is prompted to enter whether or not the displayed exercises were completed in the amount of time suggested. This step is shown by Block 46. Depending upon the input of the user, the virtual trainer device provides a fitness report showing either improving or declining fitness, as is indicated by Block 48. The entire process is then repeated at the time of the next exercise period, as is indicated by Block 50.

Stretching Mode

One of the modes prompted is the Stretching Mode 35. If a user selects the Stretching mode 35, various stretching exercises are sequentially displayed on the display 12 (FIG. 1). In addition to the stretching exercise being displayed, a corresponding audible instruction may also be produced. For example, if the stretching exercise is touching one's toes, an audible instruction may announce "Grab your toes for five seconds—four—three—two, and release." The audible commands provided are intended to mimic the commands provided by a personal trainer.

The Stretching mode is a relatively easy mode to perform. If a user selects one of the harder exercise modes, the Stretching mode may be the initial default. In this manner, a person will be prompted to stretch prior to performing some of the more difficult exercises. As such, even if a person does not directly select the Stretching mode, the exercises of the Stretching mode may be prompted first as a precursor to another selected mode.

Isometrics Mode

The Isometric mode of the present invention virtual trainer device presents a user with a variety of isometric exercises. The exercises are slow and are designed to improve strength and limberness rather than to elevate heart rate. As such, the isometric exercises presented typically do not cause the user to break a sweat. This enables the exercises to be performed most anywhere, such as sitting at a desk, at work, sitting in a car and the like. The isometric exercises typically set one muscle group against another or against gravity. For example, an isometric exercise may be to push your hands together for thirty seconds. Another isometric exercise may be to hold you arm out straight for twenty seconds. The duration of the entire exercise mode, however, is very brief and typically lasts between only twenty seconds and five minutes.

Aerobics Mode

The Aerobics mode of the present invention virtual trainer device presents a user with a variety of aerobic exercises that are intended to raise the heart rate and produce a sweat. The aerobic exercises elevate the heart rate and maintain the elevated heart rate for at least twenty minutes so as to create increased cardiac benefits and caloric reduction from the exercise. Aerobic exercise may include running in place, jumping jacks, skipping rope and the like. The exercises are shown on the display 12 (FIG. 1). Audible commands are given to help a user stay on pace. For example, during jumping jacks, the virtual trainer device can call out the pace count "One, two, three, four. Again, one, two, three, four." Inspirational audible comments, such as "up higher" or "only ten more times" can be periodically produced when appropriate. Again the purpose of the audible commands is to mimic the commands of a personal trainer.

Anything Goes Mode

The Anything Goes mode of the present invention virtual trainer device presents a user with a wide variety of difficult exercises that assumes the user does not have space constraints. For example, the virtual trainer device may prompt a user to run as fast as he/she can for twenty seconds. The virtual trainer device counts down the twenty seconds aloud. Alternately, the virtual trainer device can prompt a user to do ten push-ups, ten sit-ups or the like. Like with other modes, the virtual trainer device can produce encouraging remarks while the exercises are being performed. The duration of the anything goes mode is short and is preferably between thirty seconds and five minutes.

Discreet Mode

The Discreet mode of the present invention virtual trainer device presents a user with a variety of exercises that can be done discreetly in crowded public places such as a theater or on a bus. The exercises mostly involve muscle crunches where various muscles groups are contracted for specified periods of time. During operations in the Discreet mode, the audible signals produced by the virtual trainer device are kept to a minimum, so as to be discreet and not to be perceivable by others that may surround the user. The duration of the Discreet mode is short and is preferably between thirty seconds and five minutes.

Different Mode

The Different mode of the present invention virtual trainer device presents a user with a variety of exercises that are intended to exercise some of the minor muscle groups that are neglected by typical exercises. For example, when in the Different mode, the virtual trainer device may prompt a user to make faces to exercise the muscles in the face. The virtual trainer device may prompt a user to sing aloud to exercise the muscles that control the larynx. The duration of the Different mode is short and is preferably between thirty seconds and five minutes.

After a particular mode of exercise is complete, a user is prompted to enter the results of the exercise routine into the virtual trainer device. This is indicated by Block 46 in FIG. 2. The virtual trainer device prompts the user as to whether or not the exercises were complete and whether or not the completed exercises were completed in the allotted time. Once the results of the exercises are entered, the virtual trainer device provides a fitness report, as in indicated by Block 48. The fitness report can indicate several aspects of fitness, including calories burned, muscle groups exercised and the like.

Figure 3:
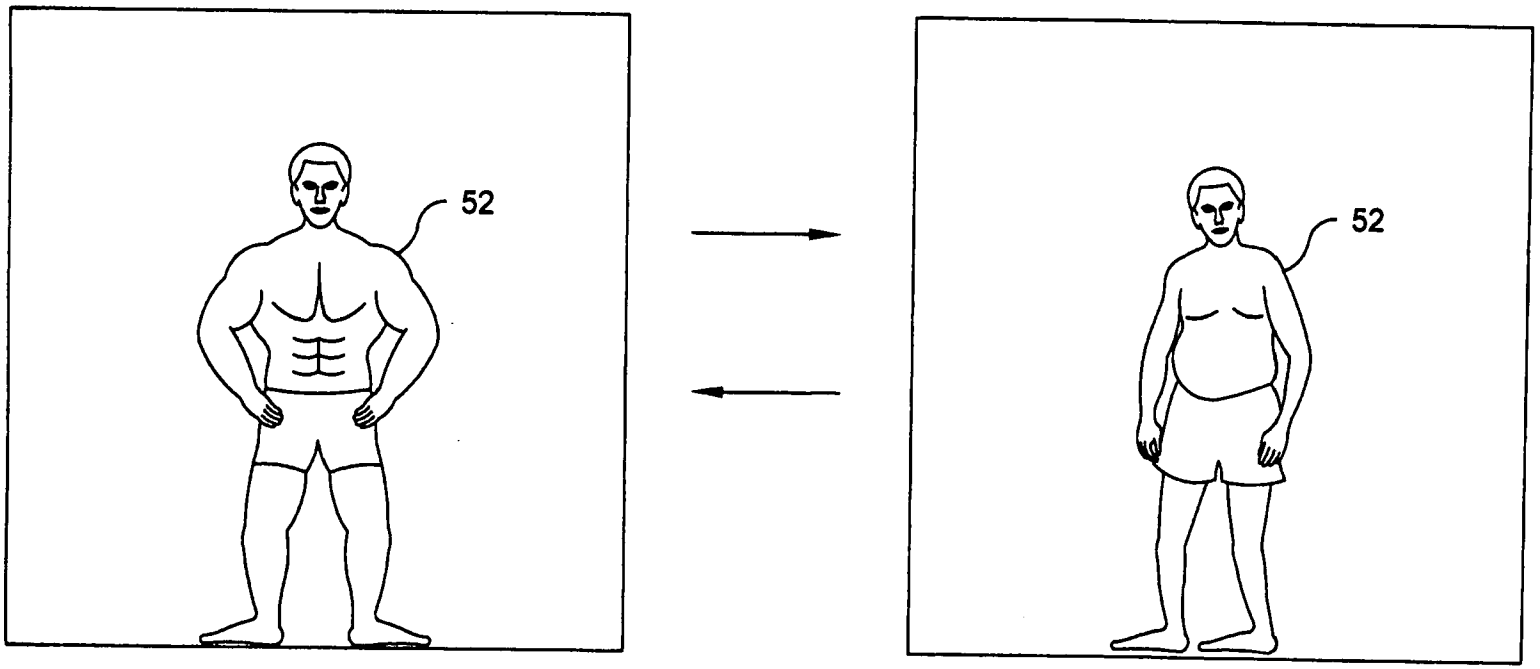
FIG. 3 shows two forms of a changing display presented by the virtual trainer device.

As is indicated by Block 48 in FIG. 2, the user of the virtual trainer device is provided with a health report after each exercise period. Preferably, the health report is a graphical depiction of the users body. Referring to FIG. 3, it can be seen that the virtual trainer device also provides a graphical depiction 52 of the person's fitness. At the beginning of the day, the person's health is depicted as a body in poor health. The body can be emaciated, obese, old or in any other way shown not to be in the prime of health. As a person successfully performs the exercises prompted by the virtual trainer device, the health of the graphical depiction 52 improves. If a person successfully performs a full days worth of exercises, the graphical depiction is shown in perfect health with the body of a superhero. However, if exercises are not completed or are skipped, the graphical depiction 52 becomes less muscular. The graphical depiction 52 is accompanied by either praising or astonishing audible statements selected to congratulate successful exercise regimens and embarrass unsuccessful exercise routines.

Returning to FIG. 2, it can be seen that after the step of presenting the fitness report (Block 48), the virtual trainer device waits for the next random exercise period (Block 50). Depending upon the cycle time between exercise modes and the exercise modes selected, the total time spent exercising in an average day preferably ranges from between ten minutes to two hours.

Since the present invention virtual trainer device tells a person when to exercise, instructs the users as to what exercises to perform, illustrates the exercises, times the exercises, provides audible encouragement during the exercise and monitors the completion of the exercises, the device serves the same function as a personal trainer. However, since the device is electronic in nature, the device serves as a virtual trainer.

After having completed various exercise modes in a particular day, the virtual trainer device can calculate how many calories have been burned. Using the menu button 18 (FIG. 1) a person can access a display menu that contains a heading for diet and a heading for lifestyle. By selecting the diet heading, a user is prompted to enter all food and drink that has been consumed in the day. The entering of food and drink can be done using the direction buttons 20 (FIG. 1) and providing a selection list of various foods, drinks and quantities.

Figure 4:
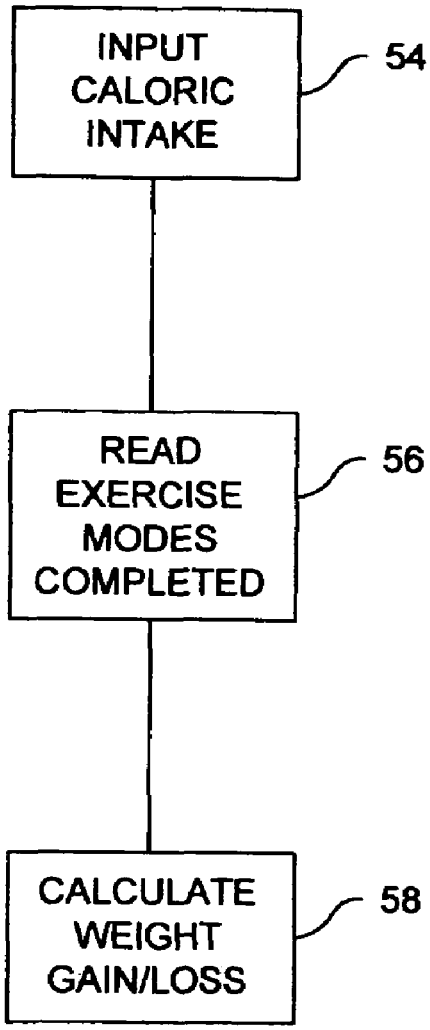
FIG. 4 is a schematic flow diagram showing secondary features of the virtual trainer device.

Referring to FIG. 4, it can be seen that once the virtual trainer device has the total caloric intake for a day (Block 54), the virtual trainer device can compare that caloric intake to the total calories burned by exercise and metabolism during that same day (Block 56). The virtual trainer device can then calculate net weight gain or net weight loss for the day (Block 58). This information can be displayed as part of the fitness report. See Block 48, FIG. 2.

By utilizing the present invention virtual trainer device, a person is prompted to begin an exercise routine. The exercises are spread out over the course of the day in short periods of time that typically last less than five minutes. As a result, the present invention virtual trainer device motivates people to exercise at work, while commuting, and while at home without requiring a large commitment of time. The virtual trainer device can also motivate people to control their caloric intake or balance their caloric intake with exercise. In this manner, people can better monitor and control their weight.

In the embodiment of FIG. 1, the exemplary embodiment of the present invention virtual trainer device is square. Such a shape is merely exemplary. The housing of the virtual trainer device can be manufactured into most any shape, such as a dumbbell, a ball or a corporate trademark.

The operation of the present invention virtual trainer device is software driven. As such, the manner and images used to select and display the various exercises are as boundless as the imagination of the programmer. Regardless of how the program is written, the program contains the following key features. The program presents a variety of different types of exercise modes that are appropriate for different situations. The exercises should be varied, wherein some of the exercise modes contain exercises that are hard and some of the exercise modes contain exercises that are easy. The program should instruct a user as to how to perform the various exercises and should present a time frame in which those exercises should be performed.

One optional aspect of the operational program is the ability to provide audible signals and commands to motivate the completion of the exercises. Another optional aspect of the operational program is to provide a fitness report. Yet another optional aspect of the present invention is the selective comparison between calories burned and caloric intake for the purposes of monitoring weight.

It will also be understood that the embodiment of the present invention virtual trainer device and method that are described and illustrated herein are merely exemplary and a person skilled in the art can make many variations to the single exemplary embodiment shown without departing from the scope of the present invention. All variations, modifications and alternate embodiments to these structures that serve the stated function are intended to be included within the scope of the present invention as defined by the appended claims.

What is claimed is:

1. A method for prompting and instructing an exercise routine, comprising the steps of:

providing an electronic device having a display, a start button and a plurality of function buttons;

having said electronic device randomly select multiple exercise periods during a day;

displaying a selection of different groupings of exercise on said display at a start of each of said exercise periods, wherein each grouping of exercise contains at least one exercise activity appropriate for different locations and circumstances;

selecting one of said groupings of exercise utilizing at least one of said function buttons;

pressing said start button to start a time frame in which to perform a selected grouping of exercise;

presenting an instructional depiction on said display of said selected grouping of exercise; and inputting into said electronic device if said selected grouping of exercise was completed within said time frame.

2. The method according to claim 1, wherein said step of presenting an instructional depiction includes providing a visual demonstration of said selected grouping of exercise on said display.

3. The method according to claim 1, wherein said step of presenting an instructional depiction includes providing audible instructions of said selected grouping of exercise.

4. The method according to claim 1, further including the step of calculating calories burned by said selected grouping of exercise.

5. The method according to claim 4, further including the steps of inputting into said electronic device calories consumed by a person.

6. The method according to claim 5, further including the step of comparing calories burned by exercise to calories consumed and providing an indication on said display whether calories were gained or lost.

7. The method according to claim 1, further including the step of providing audible phrases of inspiration during said time frame.

8. The method according to claim 1, further including the step of providing a visual indication of fitness on said display after said selected grouping of exercise is completed.

9. The method according to claim 8, wherein said visual indication is a graphical depiction of a body that varies between a poor health depiction and a good health depiction, wherein said graphical depiction changes from said poor health depiction toward said good health condition each time said selected grouping of exercise is completed.

10. The method according to claim 9, wherein said graphical depiction changes toward said poor health depiction each time said selected grouping of exercise is not completed.

11. The method according to claim 1, wherein said different groupings of exercise contains a stretching grouping that includes at least one stretching exercise activity.

12. The method according to claim 1, wherein said different grouping of exercise contains an isometric grouping that includes at least one isometric exercise.

13. The method according to claim 12, wherein said different grouping of exercise contains an aerobic grouping that includes at least one aerobic exercise.

14. A method of motivating a person to periodically exercise, said method comprising the steps of:

providing an electronic device with a display, a start button and function buttons, wherein said electronic device at random intervals during a day indicates that exercise should be performed;

displaying a selection of different types of exercises at each of said intervals, when said electronic device indicates that exercise should be performed;

using said function keys to select a type of exercise from said selection of different types of exercises each time said electronic device indicates that exercise should be performed, wherein the selected type of exercises is one that can be performed at that time given the location and circumstances of the person;

displaying instructions of how to perform the selected type of exercise on said display once the type of exercise is selected;

setting a time period for performing the selected type of exercise; and inputting into said electronic device if the selected types of exercise were performed in said time period.

15. The method according to claim 14, wherein said step of displaying instructions includes pictorially demonstrating the selected type of exercise on said display.

16. The method according to claim 14, further including the step of providing a visual indication of fitness on said display after said selected grouping of exercise is completed.

17. The method according to claim 16, wherein said visual indication is a graphical depiction of a body that varies between a poor health depiction and a good health depiction, wherein said graphical depiction changes from said poor health depiction toward said good health condition each time said selected grouping of exercise is completed.

18. The method according to claim 14, further including the step of providing audible phrases of inspiration during said time period in which said at least one exercise is to be performed.

19. The method according to claim 14, wherein said variety of different types of exercise include stretching exercises, isometric exercises, and aerobic exercises.

20. The method according to claim 14, wherein said variety of different types of exercises are selected from a group consisting of callisthenic exercises, stretching exercises, isometric exercises, aerobic exercises, facial muscle exercises, vocal exercises, breathing exercises and neck muscle exercises.

* * * * *